US011801425B2

(12) United States Patent
Bright

(10) Patent No.: US 11,801,425 B2
(45) Date of Patent: Oct. 31, 2023

(54) BALL STORAGE CARRIER AND HOPPER

(71) Applicant: BRIGHT APPLIED PRODUCTS CORPORATION, San Clemente, CA (US)

(72) Inventor: Kenneth F. Bright, San Clemente, CA (US)

(73) Assignee: BRIGHT APPLIED PRODUCTS CORPORATION, San Clemente, CA (US)

( * ) Notice: Subject to any disclaimer, the term of this patent is extended or adjusted under 35 U.S.C. 154(b) by 290 days.

(21) Appl. No.: 17/070,494

(22) Filed: Oct. 14, 2020

(65) Prior Publication Data

US 2021/0106881 A1 Apr. 15, 2021

Related U.S. Application Data

(60) Provisional application No. 62/915,140, filed on Oct. 15, 2019.

(51) Int. Cl.
*A63B 47/02* (2006.01)
*A63B 102/02* (2015.01)

(52) U.S. Cl.
CPC ..... *A63B 47/02* (2013.01); *A63B 2102/02* (2015.10); *A63B 2210/50* (2013.01)

(58) Field of Classification Search
CPC ... A63B 47/02; A63B 47/002; A63B 2102/02; A63B 2210/50; A63B 71/023; A63B 60/58
See application file for complete search history.

(56) References Cited

U.S. PATENT DOCUMENTS

| | | | | |
|---|---|---|---|---|
| 698,226 | A * | 4/1902 | Roberts | A63B 47/02 294/99.1 |
| 771,886 | A * | 10/1904 | Smith | A63B 47/02 294/99.1 |
| 2,628,804 | A | 2/1953 | Goodman | |
| 3,117,814 | A | 1/1964 | Webb | |
| 3,316,008 | A | 4/1967 | Baugh | |
| 3,371,950 | A * | 3/1968 | Stap | A63B 47/02 294/19.2 |
| 3,963,103 | A | 6/1976 | Cowen, III | |
| 4,042,156 | A | 8/1977 | Knight | |
| 4,063,769 | A | 12/1977 | Zimmer | |
| 4,072,256 | A | 2/1978 | Young | |

(Continued)

FOREIGN PATENT DOCUMENTS

| | | |
|---|---|---|
| DE | 8707231 U1 | 9/1987 |
| WO | 1995023632 A1 | 9/1995 |
| WO | 2021076611 A1 | 4/2021 |

OTHER PUBLICATIONS

International Search Report and Written Opinion, dated Jan. 12, 2021 in PCT/US2020/055559.

*Primary Examiner* — Stephen A Vu
(74) *Attorney, Agent, or Firm* — Veros Legal Solutions, LLP

(57) ABSTRACT

A sports ball carrier is configured to fit inside a storage bag with ball rackets. The carrier may store sports balls in a substantially planar array that is one sports ball thick, and the width of the carrier may taper along its length generally simulating a racket form factor. A sports ball entry port may be provided for ball collection in a manner similar to a conventional ball hopper.

17 Claims, 7 Drawing Sheets

(56) References Cited

U.S. PATENT DOCUMENTS

| | | | | |
|---|---|---|---|---|
| 4,088,251 | A | 5/1978 | Rodriguez | |
| 4,643,317 | A | 2/1987 | Wilkinson et al. | |
| 4,793,394 | A | 12/1988 | Cohen | |
| 5,086,948 | A | 2/1992 | Slusarz | |
| 5,464,262 | A | 11/1995 | Madrazo | |
| 5,472,189 | A | 12/1995 | Pfeiffer et al. | |
| 5,639,133 | A | 6/1997 | Mote | |
| 5,655,695 | A | 8/1997 | Anderson et al. | |
| D386,925 | S | 12/1997 | Hogan | |
| 5,951,075 | A | 9/1999 | Green | |
| 5,975,293 | A | 11/1999 | Fowler | |
| 6,142,544 | A | 11/2000 | Benzoni et al. | |
| 6,419,600 | B1 | 7/2002 | York et al. | |
| 6,422,621 | B1 | 7/2002 | Tandlich | |
| 6,926,328 | B2 | 8/2005 | Hellerson | |
| 7,165,796 | B1 | 1/2007 | Hung | |
| 7,377,565 | B1 | 5/2008 | Beavin | |
| 7,395,930 | B2 | 7/2008 | Tauchen | |
| 7,398,888 | B1 | 7/2008 | Nowak | |
| 8,141,919 | B2 | 3/2012 | Turdo | |
| 8,297,669 | B2 | 10/2012 | Matthews | |
| 8,328,254 | B1 | 12/2012 | Zats | |
| 9,039,547 | B2 | 5/2015 | Yeager | |
| 9,271,552 | B2 | 3/2016 | Ostenbridge | |
| 9,339,698 | B2 | 5/2016 | Zhang et al. | |
| 9,339,705 | B1 | 5/2016 | Shodhan | |
| 9,839,816 | B2 | 12/2017 | Qiu et al. | |
| 9,975,021 | B1 | 5/2018 | Sokolik | |
| 10,232,228 | B2 | 3/2019 | Eaglin et al. | |
| 11,612,788 | B2 | 3/2023 | Bright | |
| 2003/0025272 | A1* | 2/2003 | Billig | A63B 67/06 273/400 |
| 2006/0226038 | A1 | 10/2006 | Lampley | |
| 2007/0017948 | A1 | 1/2007 | Smithson | |
| 2011/0204664 | A1 | 8/2011 | Turdo | |
| 2012/0099959 | A1 | 4/2012 | Bulatao | |
| 2012/0273540 | A1 | 11/2012 | Preston | |
| 2016/0256751 | A1* | 9/2016 | Barandao | A63B 47/002 |
| 2017/0361176 | A1* | 12/2017 | Sherr | B65G 1/07 |
| 2018/0001172 | A1* | 1/2018 | Sutta | A63B 71/00 |
| 2021/0106881 | A1 | 4/2021 | Bright | |

* cited by examiner

BALL STORAGE CARRIER AND HOPPER

RELATED APPLICATIONS

This application claims priority to U.S. Provisional Patent Application No. 62/915,140, filed Oct. 15, 2019. The entire disclosures of all the related applications set forth in this section are hereby incorporated by reference in their entireties.

BACKGROUND

Conventional ball hoppers generally function by holding the hopper by the handle(s) and pushing a collection vessel such as a basket down directly over a ball to be collected, wherein the ball enters an opening on the bottom of the hopper.

Some such conventional hoppers can be made of wire and compress the ball so it fits through gaps in its frame when such hoppers are pushed down over a ball. The ball returns to its original size once inside the vessel or basket and is kept inside as the gaps are generally smaller than that which would allow the balls to easily exit such hoppers. Such baskets can have a lid to contain the balls. Such a lid generally must be opened to retrieve the balls, and such baskets can easily spill. Some other conventional hoppers may be tube shaped. In any event, such conventional hoppers are awkward to pack and do not generally fit in a typical bag for racket sports. And if they are able to fit inside a bag for racket sports, they typically do not hold a sufficient number of balls for practicing or require the use of a separate holder such as a basket to dispense the balls. In addition, conventional hoppers can have many moving parts, for example, legs, handles, a lid to close/open for retention/removal of balls and can also be heavy due to their large size and/or use of metal bars and rigid frames.

It is difficult to carry a bag, all gear and, for example, such a conventional ball hopper containing numerous balls. Carrying these items can be made even more difficult because such conventional hoppers may have legs that are too large to fit in such a racket shaped bag. It is also difficult to keep such bags organized to facilitate removing items therefrom and return items thereto. Balls, for example, when stored loosely, impede the ability to easily return a racket to the bag and do not provide a convenient way to carry the balls to a court for playing. It is also difficult or inconvenient to remove loose balls individually in sufficient number to practice. Further, if balls are stored in an unstructured bag, the ability to easily return a racket to the bag is likewise impeded. Moreover, gear may interfere with protecting the sensitive strings on a racket from losing tension if the gear is not organized properly.

It should be noted that this Background is not intended to be an aid in determining the scope of the claimed subject matter nor be viewed as limiting the claimed subject matter to implementations that solve any or all of the disadvantages or problems presented above. The discussion of any technology, documents, or references in this Background section should not be interpreted as an admission that the material described is prior art to any of the subject matter claimed herein.

SUMMARY

In one implementation, a ball carrier is configured to hold a plurality of sports balls. The carrier may comprise a first frame portion defining a first substantially planar geometric shape and a second frame portion defining a second substantially planar geometric shape. The first frame portion and the second frame portion may be positioned substantially parallel to each other to form a sports ball carrier having an internal volume defined by the first frame portion and the second frame portion for holding a plurality of sports balls. The internal volume may have a thickness between the substantially parallel planes of the first frame portion and the second frame portion such that the first frame portion and the second frame portion capture the sports balls in the internal volume of the carrier as a substantially planar, one sports ball thick array.

In another implementation, a ball carrier comprises a frame defining an internal volume for holding a plurality of sports balls, wherein the internal volume defined by the frame comprises a length, a maximum width, a minimum width, and a thickness. In this implementation, the length is at least 1.5 times the maximum width, and the maximum width is at least 3 times the thickness.

In any embodiment, the frame may taper from a maximum width to a minimum width along the length. In any embodiment, the thickness may be substantially constant. In any embodiment, the carrier may comprise a sports ball entry port. In any embodiment, the sports ball entry port may be configured to deform a sports ball as the sports ball passes through the sports ball entry port so the carrier may function as a hopper. In any embodiment, the sports balls may comprise tennis balls.

It is understood that various configurations of the subject technology will become apparent to those skilled in the art from the disclosure, wherein various configurations of the subject technology are shown and described by way of illustration. As will be realized, the subject technology is capable of other and different configurations and its several details are capable of modification in various other respects, all without departing from the scope of the subject technology. Accordingly, the summary, drawings and detailed description are to be regarded as illustrative in nature and not as restrictive.

BRIEF DESCRIPTION OF THE DRAWINGS

Various embodiments are discussed in detail in conjunction with the Figures described below, with an emphasis on highlighting the advantageous features. These embodiments are for illustrative purposes only and any scale that may be illustrated therein does not limit the scope of the technology disclosed. These drawings include the following figures, in which like numerals indicate like parts.

DETAILED DESCRIPTION

The following description and examples illustrate some exemplary implementations, embodiments, and arrangements of the disclosed invention in detail. Those of skill in the art will recognize that there are numerous variations and modifications of this invention that are encompassed by its scope. Accordingly, the description of a certain example embodiment should not be deemed to limit the scope of the present invention.

Implementations of the technology described herein are directed generally to carriers used for collecting and storing balls, such as tennis balls. The carrier herein simultaneously solves multiple problems, at least in part, by reducing the number of separate articles of gear necessary to carry to a location to practice a racket sport, providing a spacing element to organize gear, and protecting gear inside a racket shaped bag, while incorporating a lightweight hopper with a ball carrier, and providing a removable receptacle that may contain a sufficient number of balls to be useful for practice, and therefore is functionally significant, novel and inventive over conventional carriers/hoppers. By solving these and other problems, the carrier herein functions with a different purpose from other carriers that are unable to simultaneously perform all functions of the present carrier. Advantageously, the present carrier also saves time by providing for the removal of a large number of balls at once and for storing balls in a racket shaped bag.

Carriers described herein may retrieve balls and then, in some aspects, the entire apparatus may be stored inside a racket bag typically and specifically intended to hold rackets and other gear without impeding the ability to return a racket to the bag while the carrier is inside the bag. In some embodiments, the carrier is useful with a bag designed to hold more than two rackets, wherein the entirety of a racket is contained on the inside of the bag, without, for example, a handle of the racket protruding therefrom. Some racket shaped bags have compartments, such as padded compartments, that increase the weight of the bags without providing an additional advantage of having a carrier that can be used for removably storing and organizing balls within the bag.

Figure 1:
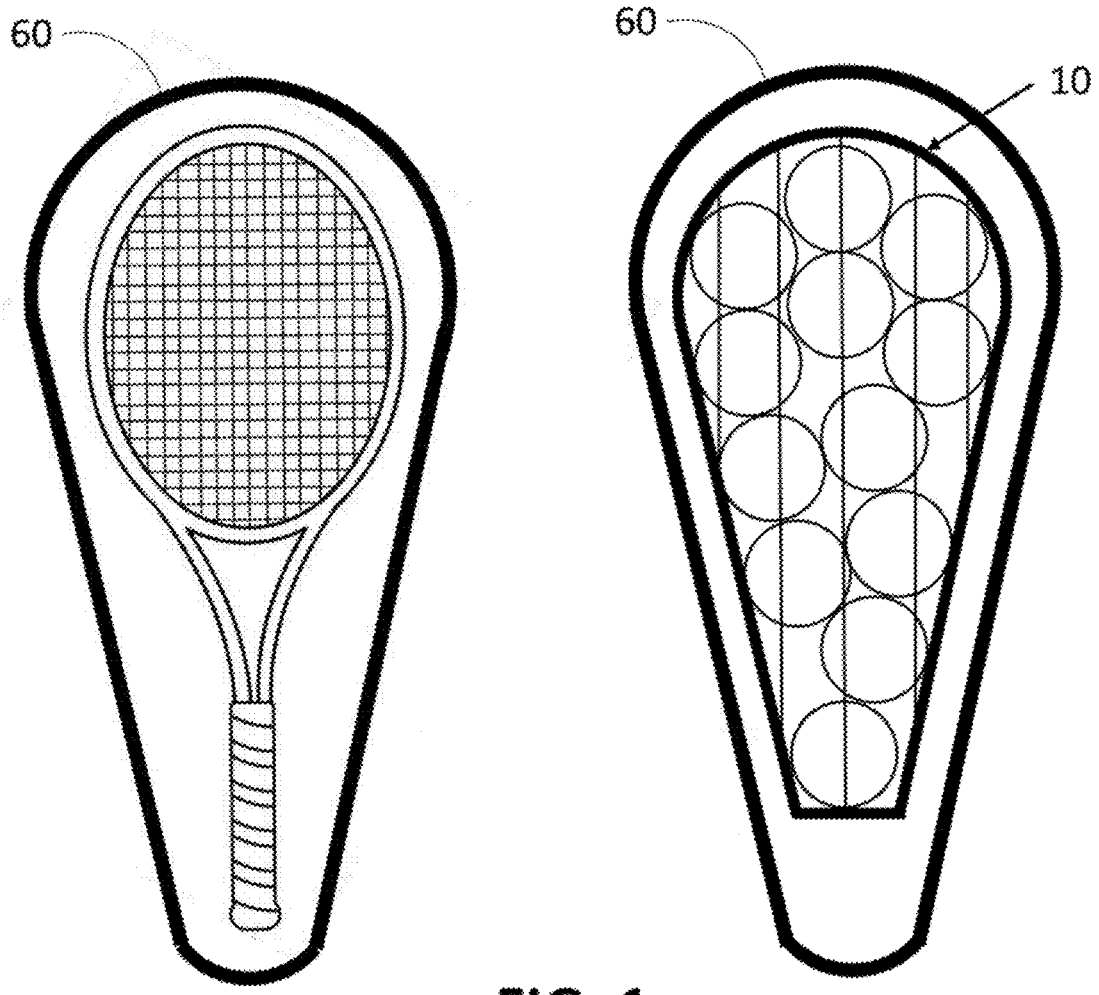
FIG. 1 shows a racket bag with a tennis racket and a ball carrier in accordance with some embodiments stored inside.

Many typical tennis racket shaped bags are shaped somewhat like a racket, i.e., one end of the bag is relatively narrower to accommodate a racket handle and an opposing end is relatively wider to accommodate the racket head. Typical tennis racket shaped bags come in several sizes, and can be designed to hold multiple rackets, for example, 3-15 rackets having a major width ranging from about 3.5" to 18". Some bags, wherein the entirety of a racket is held on the inside of the bag without the handle protruding therefrom, may be referred to as club tennis bags (e.g., non-racket), racket shaped bags with backpack straps, shoulder tote bags, tennis backpacks, tennis pro bags (e.g., rectangular), and/or climate protection bags. For ease of discussion, a bag having a relatively wide end and a tapered end for advantageously storing at least one racket and any carrier described herein entirely inside may also be referred to herein as a "racket shaped bag." FIG. 1 illustrates the general shape of many racket shaped bags 60. In the bag 60 on the left, a tennis racket is shown stored therein.

Carriers described herein may be somewhat racket shaped with a relatively wider, proximal end and a reduced width distal end, and may be about only about 3 inches thick to fit inside a racket shaped bag and to take up the space of about 2 rackets. Referring again to FIG. 1, the bag 60 on the right contains a somewhat racket shaped carrier 10. It can be seen that the carrier 10 of these embodiments fits easily into a racket shaped bag along with tennis rackets. A player could transport 10 rackets plus the carrier herein full of tennis balls (approximately 30 or about 15-30, 15-25, 20-25 tennis balls) in a single 12 pack tournament bag. In some embodiments, carriers described herein is designed to work in conjunction with equipment the player already has.

Tennis balls or balls for other racket sports such as racquetballs, squash balls and pickle balls, are usually stored loosely in a racket shaped bag or in a tubular can. Only a few, usually three balls per can, are stored and can be removed from a racket shaped bag at any one time. The present carrier herein allows removal of all balls contained within the carrier while the carrier is inside a racket shaped bag.

It would be beneficial to be able to increase the number of tennis balls that can be put in and taken out in a single motion (e.g., at one time) from a racket shaped bag, for example a tennis bag, when using one hand, while retaining the ease of sliding a tennis racket in the same bag and using the same apparatus as a hopper to eliminate carrying a separate, clumsy apparatus.

Figure 2:
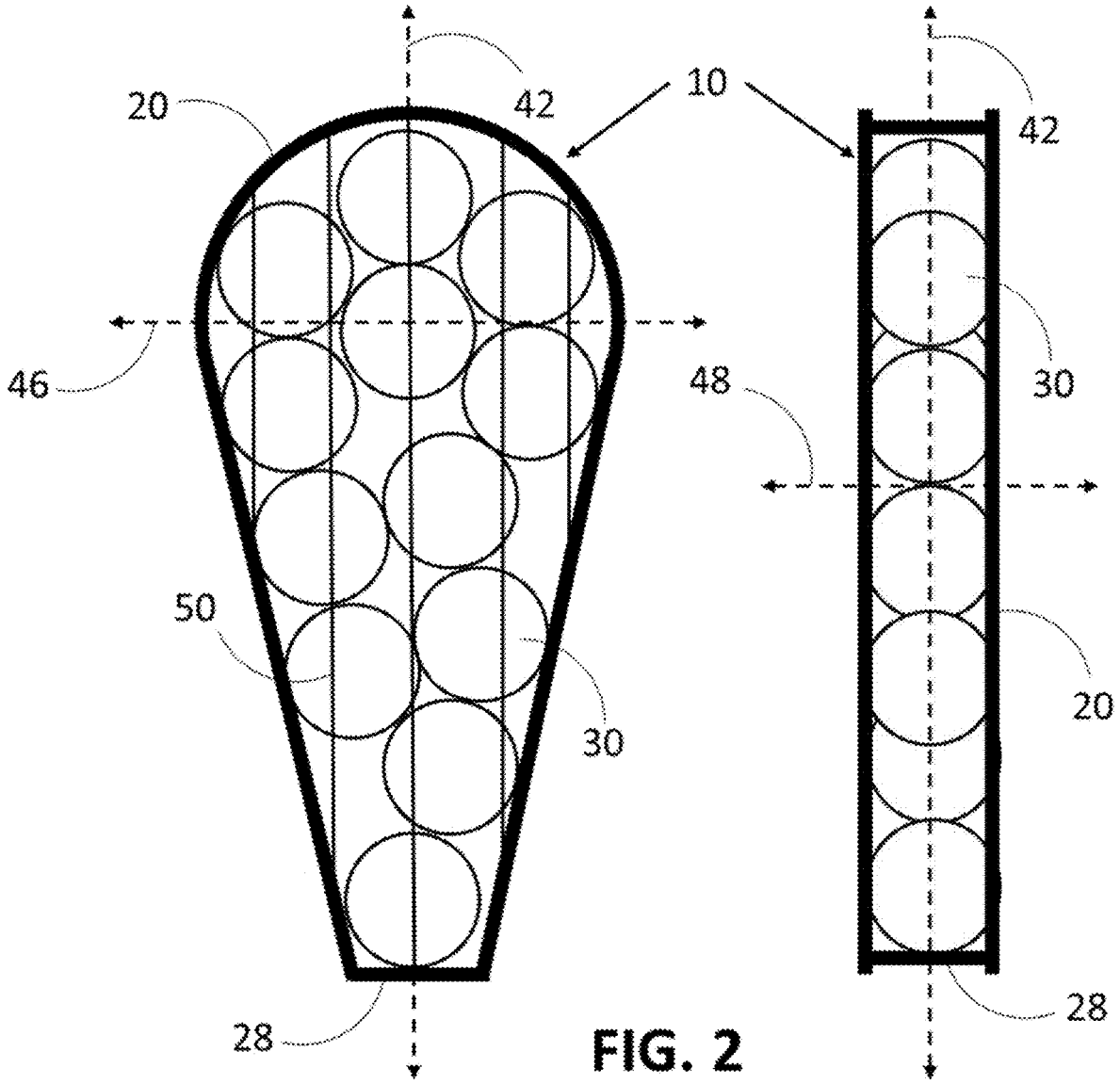
FIG. 2 shows a front view and a side view of a ball carrier in accordance with some embodiments.

FIG. 2 illustrates the ball carrier 10 of FIG. 1 in more detail. In this embodiment, the ball carrier 10 comprises a frame 20. The frame defines an internal volume in which sports balls 30 can be stored. The shape of the frame may be characterized by a longitudinal axis 42, a transverse axis 48, and a maximum width axis 46 that is also perpendicular to the longitudinal axis 42. A ball entry port 28 is provided on the bottom of the ball carrier 10. The sports balls 30 are captured within the internal volume by (1) outer edges of the frame that are separated by less than the width of the sports balls 30, and (2) flexible strings 50 that span larger openings on the front and rear faces ball carrier 10. Although the balls remain captured inside the frame naturally, a user can pull a ball 30 out of the carrier manually between the strings 50 when the user deforms the strings reaching in and grabbing a sports ball.

Some specific embodiments of a ball carrier according to this disclosure will now be described in connection with FIGS. 3-11.

Figure 3:
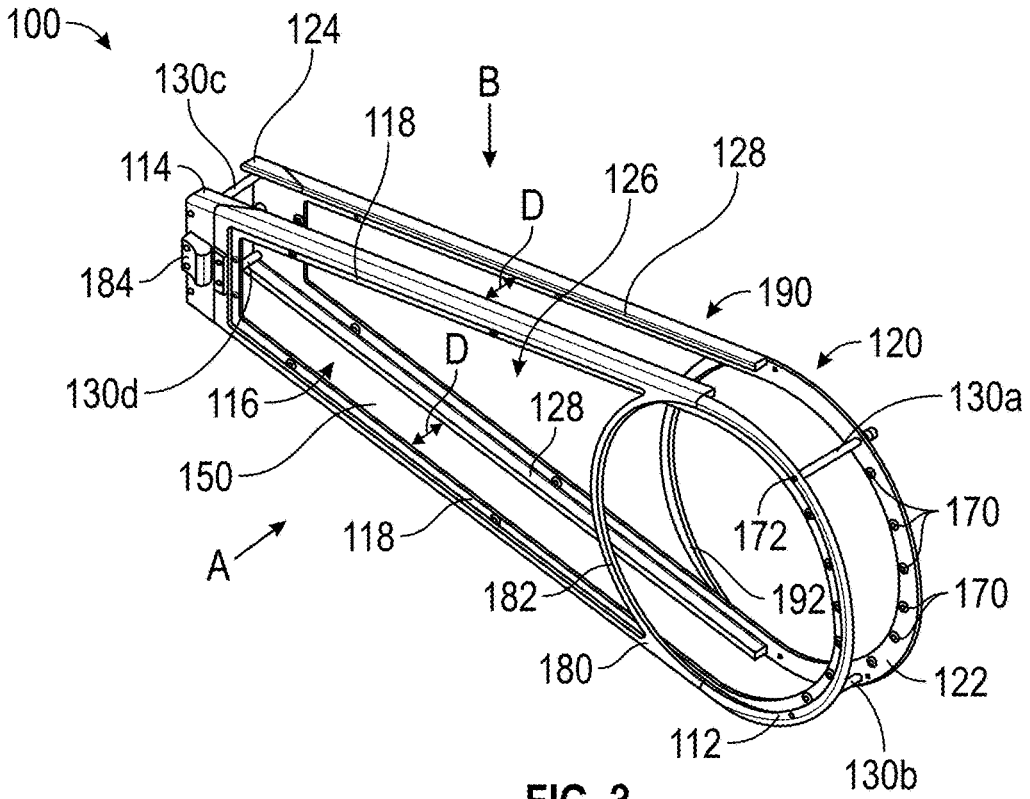
FIG. 3 shows a perspective view of a carrier frame with optional collapsible legs in collapsed positions, in accordance with some embodiments.
Figure 4:
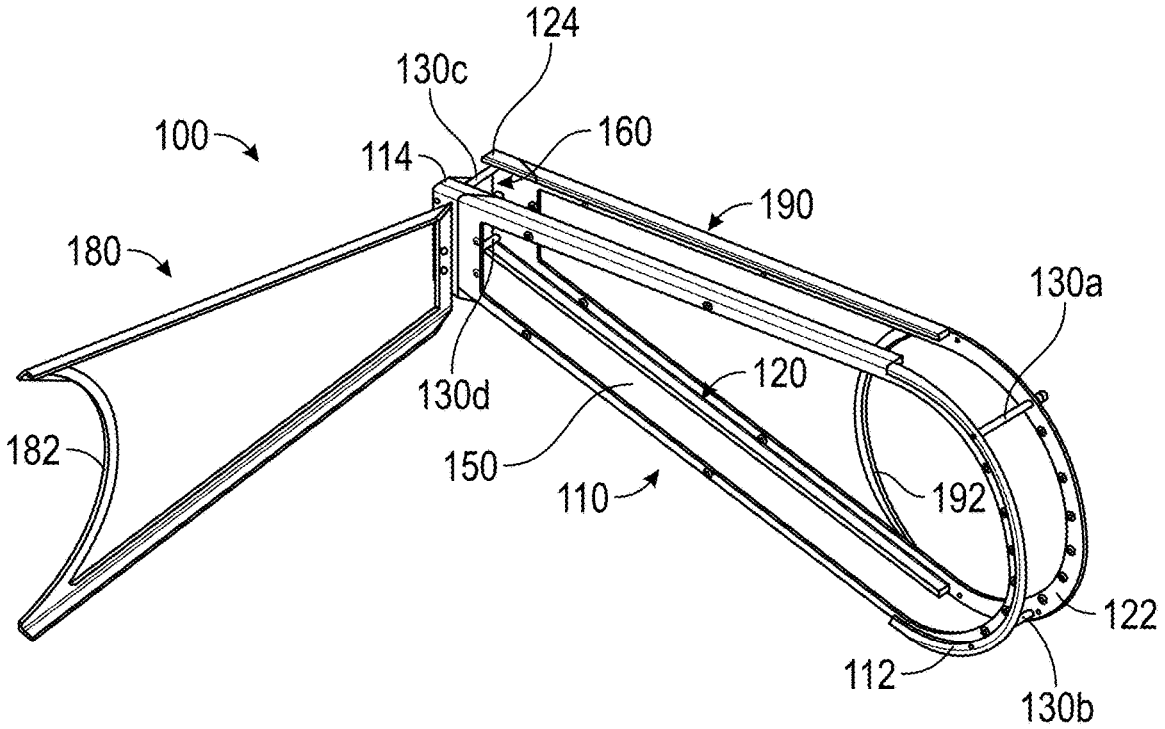
FIG. 4 shows a perspective view of the carrier frame of FIG. 3 with one of the optional collapsible legs in an extended position, in accordance with some embodiments.
Figure 5:
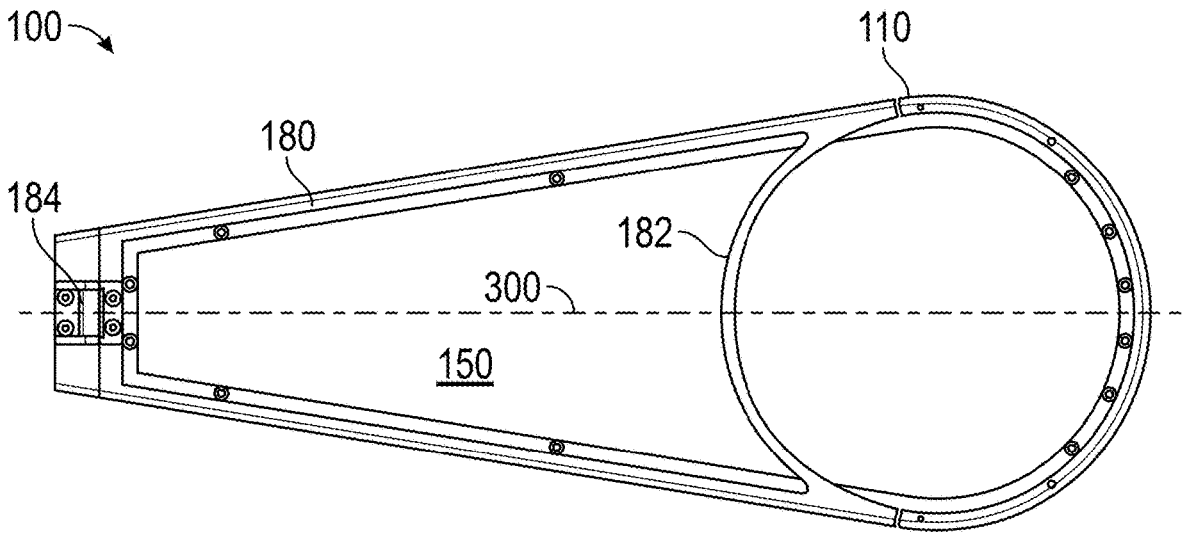
FIG. 5 shows a side view of the carrier frame of FIG. 3 as viewed in the direction of the arrow A in FIG. 3, in accordance with some embodiments.

As illustrated in at least FIGS. 3 and 4, a ball carrier 100 comprises a rigid or semi-rigid frame formed from a first side panel 110 and a second side panel 120 each having adjacent edges that are laterally spaced from one another by a predetermined distance D, which may depend on a size of the type of ball carrier 100 is configured to collect and/or store. For example, the official tennis ball size is between 2.575" and 2.7" as defined by the International Tennis Federation. Thus, in some embodiments, where tennis ball collection is contemplated, D should be less than about 2.575" so that there is some measure of resistance that allows such tennis balls to be retained within carrier 100. Similarly, a racquetball ball has a 2.25" diameter and squash balls have a diameter of 1.56"-1.59", so D may be less than the diameter of the respective balls. In some other embodiments, D may be 2⅛" or greater such as about 2¼"-2⅜". In some embodiments, the distance D between first and second side panels 110, 120 is constant around an entire perimeter of first and second panels 110, 120.

In some embodiments, first and second side panels 110, 120 are each substantially planar. In some embodiments, first and second panels 110, 120 may have form factors that are substantial mirror images of one another. Each of first and second panels 110, 120 may comprise any suitable material, e.g., plastic, wood, or metal, such as sheet metal, bent plate, tubular metal, and/or aluminum. Moreover, each of first and second panels 110, 120 may be laser/water cut, stamped, bent/welded, extruded, 3D printed and/or molded into their ultimate form(s), as described anywhere in this disclosure. Accordingly, the weight of carrier 100 can vary depending on the material(s) used. For example, where aluminum is utilized, carrier 100 may weigh about 2 lbs, while utilizing steel may result in carrier 100 weighing about 4 lbs, 6 oz. Accordingly, carrier 100 may weigh less than about 5 lbs, for example between about 1 and 5 lbs.

First side panel 110 comprises a proximal end 112 and a tapered distal end 114 opposite proximal end 112. Likewise, second side panel 120 comprises a proximal end 122 and a tapered distal end 124 opposite proximal end 122. The particular shape and/or dimensions of first and second side panels 110, 120 or portions thereof, and, thus, of carrier 100, may depend upon the type of racket ball(s) and/or accompanying racket shaped bag for which carrier 100 is expected or configured to be used, since proximal ends 112, 122 are configured to fit in the racket shaped bag at a wider end thereof and tapered distal ends 114, 124 are configured to fit in a narrower end thereof, opposite the wider end.

For example, where carrier 100 is configured to store regulation tennis balls, a width of proximal ends 112, 122 of first and second side panels 110, 120 may be about 4-6 times as wide as a width of tapered distal ends 114, 124. Additionally, the width of proximal ends 112, 122 may be similar to a width of a racket with which carrier 100 is configured to be used. Accordingly, for a tennis racket, the width of proximal ends 112, 122 may be the same as a width of the tennis racket. In some cases, the width of a tennis racket is about 12.5" on the larger end, and thus in some embodiments, the width of wide proximal ends 112, 122 of first and second side panels 110, 120 may be less than 12.5", for example 9"-12.5", 10"-12.5", 11.5"-12" or about 11.75".

Likewise, a width of tapered distal ends 114, 124 of first and second side panels 110, 120 may depend on a width of a type of ball that carrier 100 is configured to store and/or a width of a similarly tapered end of a racket shaped bag within which carrier 100 is configured to be stored. As will be described in more detail below, tapered distal ends 114, 124 of first and second side panels 110, 120 may form a bottom opening 160 in carrier 100 that is configured to compress balls and force them into a cavity 150 of carrier 100 for storage, providing the ball collection capabilities of a ball hopper. In some embodiments, opening 160 may be cuboid or rounded, for example circular. Where tennis balls are contemplated, a width of tapered distal ends 114, 124 may be about 2.5". Similarly, where tennis balls are contemplated, tennis racket shaped bags may have a width of about 8" or less. Thus, where tennis racket shaped bags are considered, the width of tapered distal ends 114, 124 of first and second side panels 110, 120 may be narrower than 8", for example, about 3"-7", about 2.25"-5" or about 2.25-3". Of course, configuration for different types of balls, rackets and/or racket shaped bags may result in different dimensions for one or more portions of carrier 100.

In some embodiments, proximal end 112 of first side panel 110 and proximal end 122 of second side panel 120 may each have a substantially curved form factor, e.g., having a semicircular or semielliptical form factor, that generally approximates a shape of a racket face and that is configured to similarly fit within a wider end of a racket shaped bag, traditionally configured to receive a racket face. Accordingly, a radius of such a curved form factor, as measured from an outside edge of proximal end 112 and/or from an outside edge of proximal end 122 may depend on the type of balls carrier 100 is configured to store and/or a shape of racket face at least proximal ends 112, 122 of first and second side panels 110, 120 is configured to generally approximate. Accordingly, in some embodiments where carrier 100 is configured to store regulation tennis balls, a radius of such a curved form factor, as measured from a center of the curve to an outside edge of that portion of the panel, may be about 3"-8" such as 3"-7", 4"-5.5" or about 5 inches. In some embodiments, the closer the dimensions of such a racket shaped bag are to the dimensions of carrier 100 when closed, the more balls may fit within carrier 100.

In some embodiments, proximal ends 112, 122 of first and second side panels 110, 120 each gradually slope toward respective tapered distal ends 114,124 relative to a center line 300 (see FIG. 3) that divides each of first and second side panels 110, 120 in half. In some embodiments, this slope is approximately linear and configured to generally mimic a slope of a conventional racket shaped bag, for example a tennis bag. In some embodiments, the slope may extend at an angle, from center line 300, of about 5°-20°, for example about 5°-15°, or about 10°-15° (measured as if both opposite edges of each of first and second side panels 110, 120 linearly taper to respective points). In some other embodiments, the slope may extend at an angle, from center line 300, of about 15%-40%, 17%-40%, 18%-36% or about 25%-30%.

In some embodiments, for example for tennis balls, rackets and/or racket shaped bags, such linear sloping portions of each of first and second side panels 110, 120 may be approximately 5-30 inches long, approximately 15-24 inches long, approximately 17-20 inches long, or approximately 18 inches long. Likewise, in some such embodiments, the rigid frame comprising first and second side panels 110, 120 has a length, between proximal ends 112, 122 and respective tapered distal ends 114, 124 and along center line 300, that approximates a length of the racket. Accordingly, in some such tennis embodiments, such a length along center line 300 may be about 20"-35", 25"-30" 26"-29", or 27". Of course, configuration with other balls, rackets and racket shape bags may cause this length to be greater or less than these lengths.

In some embodiments, first and second side panels 110, 120 may each comprise substantially solid surfaces such that there are no holes or apertures sufficiently large for the types of balls carrier 100 is configured to store to fall or be forced out of carrier 100.

In some other embodiments, first side panel 110 comprises at least one relatively large, main opening 116 on its surface. In some such other embodiments, second side panel 120 also comprises at least one similar relatively large, main opening 126 on its surface. As illustrated in at least FIGS. 3 and 4, these openings 116, 126 can comprise a substantial majority of the form factor of first and second side panels 110, 120 inward of narrow respective portions around the perimeters of first and second side panels 110, 120. In this way, at least first and second side panels 110, 120 can form a rigid or semi-rigid, lightweight frame of carrier 100.

However, openings 116, 126 are illustrated as substantially larger than a diameter of the type of balls carrier 100 is configured to store. Accordingly, one or more strings 720 (see FIG. 9), for example racket strings, fabric, elastic bands, mesh or netting, may be disposed across each of openings 116, 126 one or more times to form a plurality of substantially planar openings 730 (see FIG. 9). For example, strings 720 may be strung through predrilled holes 170 (see at least FIGS. 3 and 9), or using similarly positioned hooks, cleats, pegs, or notches on or disposable on the edges of first and second side panels 110, 120, thereby forming a flexible net cage. The materials used to form planar openings 730 may be supplied by the manufacturer and/or woven in an unlimited number of designs, allowing users to customize carrier 100. In some embodiments, all strings 720 may be strung to extend in a substantially horizontal direction, a substantially vertical direction, or in variously angled directions with respect to one another to form any number of woven patterns. Each of the plurality of substantially planar openings 730 may have at least one dimension that is smaller than a diameter of ball(s) 710 such that once ball(s) 700 is/are within carrier 100, they will not fall out through openings 116, 126 or planar openings 730 formed therein. Accordingly, when string(s) 720 is/are strung with sufficient tension, one way in which ball(s) 710 may be inserted into, or removed from, carrier 100 is by respectively pushing or pulling ball(s) 710 through planar openings 730 in the face of first and second side panels 110, 120.

In other embodiments, rather than each having one large opening 116, 126, one or both of first and second side panels 110, 120 may comprise cross members of any sturdy material. In some embodiments, an opening panel, such as a door (not shown), may be provided where at least a portion of openings 116, 126 are illustrated in at least FIGS. 3 and 4 to access balls 710 for removal.

Although not required, the functionality is enhanced if tapered distal end 114 of first side panel 110 and tapered distal end 124 of second side panel 120 form at least one bottom opening 160 at a distal end of carrier 100 having at least one dimension that is shorter than a diameter of the type of ball that carrier 100 is configured to hold but large enough such that the ball can deform to pass through opening 160. In this way the apparatus may function as a conventional hopper with a bottom opening for picking up balls for storage.

Accordingly, first side panel 110 and second side panel 120 are coupled to one another by at least one spacer 130*a*, 130*b*, 130*c*, 130*d*. Any number of spacers may be utilized around, e.g., a perimeter of first and second side panels 110, 120, for example 1-20, 2-15, 4-12, 4-6 for 6 such spacers of the same or different design as described anywhere herein or as otherwise known. In some embodiments, an outside diameter of spacers 130*a*-130*d* (or major or minor width where not having a circular cross-section) may be about ⅛" to ½", for example about ¼". In some embodiments, the at least one spacer 130*a*-130*d* provides the predetermined lateral spacing distance D between first side panel 110 and second side panel 120 and ensures that first and second side panels 110, 120 are disposed approximately or substantially parallel to one another. In some embodiments, at least a portion of the perimeter of at least one of first and second side panels 110, 120 may further comprise a respective ledge or L-shaped portion 118, 128 that extends inward from the respective panel 110, 120 to reduce the lateral spacing between the closest edges of first and second side panels 110, 120 to the predetermined lateral spacing D and, thereby, retain collected balls within carrier 100.

The predetermined distance D is configured to be smaller than a diameter of the type of ball that carrier 100 is configured to hold but large enough such that the ball can still deform, under reasonable force applied by a user, to pass through the space in opening 160 or elsewhere along a perimeter between first and second side panels 110, 120, provided by distance D. Accordingly, at least as illustrated in FIGS. 3 and 4, a volume disposed between each of first and second side panels 110, 120, and defined by perimeters thereof, defines a cavity 150 of ball carrier 100 within which balls 710 (see FIG. 9) can be stored or otherwise held.

In some embodiments, one or more spacers 130*c*, 130*d* couple first and second side panels 110, 120 together at their respective tapered distal ends 114, 124 and, in some such cases, define a dimension of opening 160 perpendicular to the direction of extent of the predetermined lateral spacing distance D.

To attach the one or more spacers 130*a*-130*d* to first and second side panels 110, 120, each of first and second side panels 110, 120 may comprise predrilled holes 170. In some embodiments, one or more of spacers 130*a*-130*d* may comprise a strip of metal or plastic, which may be straight, L-shaped, or have any other suitable shape. In some embodiments, one or more of spacers 130*a*-130*d* may comprise standoff posts or telescoping posts, for example, comprising two female ends each configured to be respectively secured to one of first and second side panels 110, 120, through predrilled holes 170, by screws 172. Examples of such females-female standoff posts may include those manufactured by Lyn-Tron Inc. Where such standoff posts are not capable of being stretched or collapsed, a ball is unable to enter cavity 150 of carrier 100 unless the ball is deformed sufficiently to fit through the predetermined distance D and will not fall back out of cavity 150 in its undeformed shape.

Where one or more of the spacers 130*a*-130*d* comprise telescoping posts (not shown), those posts may be locked when in use so as to provide the fixed predetermined distance D between first and second side panels 110, 120 during use, thereby preventing collected balls from easily exiting carrier 100 along a perimeter of either side panel 110, 120. In some such embodiments, telescoping posts may be useful for expanding the lateral separation distance between at least portions of first and second side panels 110, 120 from the fixed distance D when desired to, thereby, release the balls from carrier 100. For example, such a telescoping post may comprise a piece of elastic that attaches at respective ends to first and second side panels 110, 120 and runs through a hollow spacer tube of the telescoping post. The piece of elastic may be sufficiently taught (tensioned) so that the telescoping post does not open wider than a diameter of the ball during ball collection but may be forced by the user to open slightly wider than the diameter of the ball to release the balls, if needed.

In some embodiments, first and second side panels 110, 120 are sufficiently rigid to provide the predetermined spacing D therebetween during ball collection utilizing, for example, a single telescoping post, to keep the balls in cavity 150 but sufficiently flexible to allow sufficient expansion of the telescoping post, such that a spacing between at least a portion of first and second side panels 110, 120 expands beyond the diameter of the balls when emptying carrier 100. In some embodiments utilizing such telescoping posts, the spacing between first and second side panels 110, 120 may be at least partially collapsed from the predetermined distance D when not in use and can be expanded back to the predetermined distance D when ball collection is desired. Such embodiments would allow for even more compact storage of carrier 100 when not in use, which is particularly useful where carrier 100 is disposed within a racket shaped bag.

Figure 6:
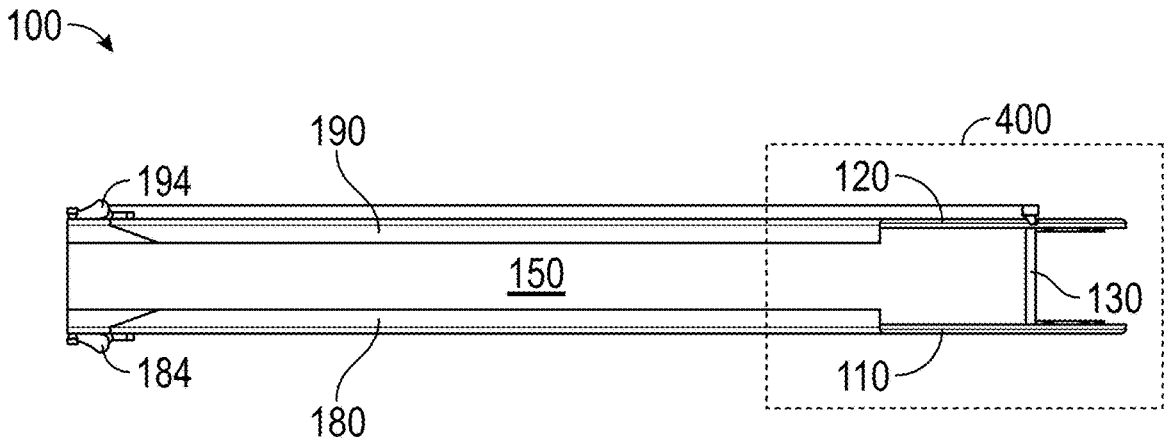
FIG. 6 shows another side view of the carrier frame of FIG. 3 as viewed in the direction of the arrow B in FIG. 3, in accordance with some embodiments.
Figure 7:
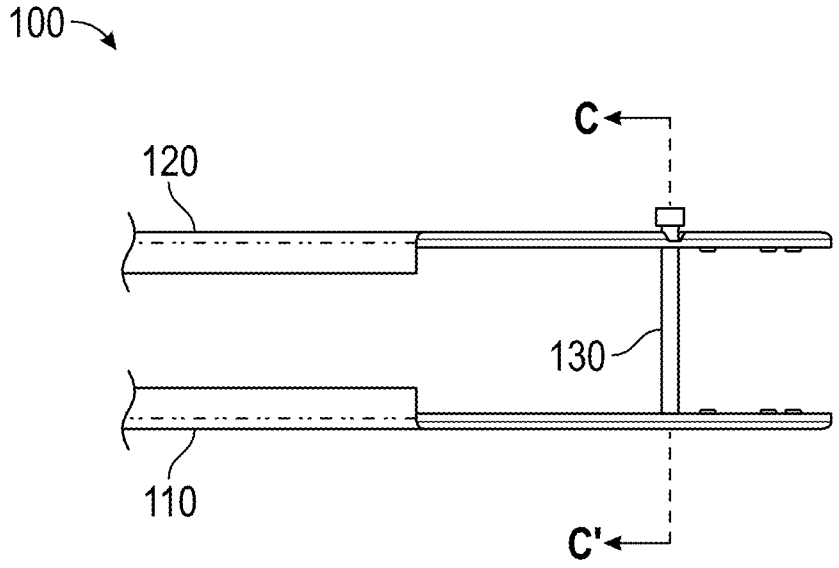
FIG. 7 shows a magnified view of a portion of the carrier frame as shown in FIG. 6, in accordance with some embodiments.

In some embodiments, for example, as illustrated in at least FIG. 6, any of spacers 130*a*-130*d* may be configured to tighten and loosen utilizing a cap screw having a cap 610, a spring 620 under cap 610, and a screw 630 coupled to cap 610 and configured to thread into one end of spacer 130. The other end of spacer 130 may be secured in place by a screw 172 as previously described in connection with at least FIGS. 3 and 4. Cap 610, and so screw 630, may then be tightened for ball collection and loosened for ball removal from carrier 100.

In some other embodiments, carrier 100 may be approximately the width of two of the type of balls it is configured to collect to increase storage capacity. In such embodiments, portions between spacers 130*a*-130*d* may be substantially solid or have hatches, doors or strings and/or netting disposed thereover, for example as described anywhere in this disclosure, to ensure the balls do not escape from the sides of carrier 100 having the increased width.

In some embodiments, carrier 100 may further comprise respective collapsible legs 180, 190 configured to fold on either side of first and second side panels 110, 120. Collapsible legs 180, 190 can be connected to or separable from first and second side panels 110, 120. In some embodiments, collapsible legs 180, 190 each comprise a respective support piece 182, 192 (e.g., a crossbar or other suitable structure), for example formed of metal and/or the same material as collapsible legs 180, 190, for supporting collapsible legs 180, 190. In some embodiments, support pieces 182, 192 are of a sufficient size and strength to support the weight of carrier 100 loaded with balls, for example tennis balls.

In some embodiments, collapsible legs 180, 190 are secured to carrier 100, e.g., to respective ones of first and second side panels 110, 120, utilizing respective hinges 184, 194. Hinges 184, 194 may be any suitable type of hinge and can include, for example, a constant torque friction hinge or a detent hinge. In some embodiments, when collapsible legs 180, 190 are opened, hinges 184, 194 can adjust to and remain at any angle so the height of carrier 100 holding the balls can be easily adjusted to accommodate the height or preference of variously sized users.

The resistance of hinges 184, 194 may be set so collapsible legs 180, 190 stop at and maintain any desired angle, even when carrier 100 is filled with balls. Collapsible legs 180, 190 may be positioned in a "splits" position (e.g., out wide so carrier 100 is nearly on the ground) or, alternatively, straight up and down (e.g., substantially perpendicular to the ground so carrier 100 is at its greatest height). Carrier 100 can also be used for target for practice. The ability to adjust the height of carrier 100 gives users variability in where they are aiming. Hinges 184, 194 also allow carrier 100 to get hit without falling over because of the resistance in hinges 184, 194, in comparison to conventional carriers/hoppers wherein the balls may spill out of a basket if hit. In addition, at least in part by utilizing string 720 to form planar openings 730 in the faces of first and second side panels 110, 120, carrier 100 may, in some cases, "catch" balls that are hit precisely into the string pattern, which is beneficial when practicing to hit balls at a specific location.

In some embodiments, collapsible legs 180, 190 mimic the shape of first and second side panels 110, 120, i.e., having a similar proximal end and a tapered distal end, as shown in at least FIGS. 3 and 4, so that carrier 100 can fit in a racket shaped bag when collapsible legs 180, 190 are at least partially collapsed.

While carrier 100 embodiment specifically described herein may be used to collect balls through opening 160 at tapered ends 114, 124 of first and second side panels 110, 120, in some embodiments, carrier 100 may also be inverted, allowing more than one ball to be picked up at a time through a side of carrier 100 other than at opening 160 near tapered distal ends 114, 124 of first and second side panels 110, 120, such as at the curved portion of proximal ends 112, 122 of first and second side panels 110, 120. When using the curved portion of proximal ends 112, 122 to collect balls, a rolling motion may be used to pick up the balls, making it easier to pick up the balls than by pressing down on carrier 100 when each ball is properly disposed under opening 160. Using the curved portion of proximal ends 112, 122 has the added benefit of being compatible with a natural walking motion when walking around to pick up the balls. Accordingly, in some such embodiments, carrier 100 comprises at least two openings for collecting balls: opening 160 near respective tapered distal ends 114, 124 of first and second side panels 110, 120, and another opening formed between, e.g., spacers 130*a*, 130*b* near the curved portion of proximal ends 112, 122 of first and second side panels 110, 120. In some embodiments, at least one additional opening for collecting balls may also be present on each side of carrier 100 between, e.g., spacers 130*a* and 130*c* along one linearly sloping edge of carrier 100 and between, e.g., spacers 130*b* and 130*d* along the other linearly sloping edge of carrier 100.

In some other embodiments, carrier 100 may be nested inside a rigid nesting frame (not shown) that can be converted to a stand to elevate carrier 100 containing the collected balls at a height that can be easily used while practicing. In some embodiments, carrier 100 further comprises such a rigid nesting frame having similar, wider proximal ends and tapered distal ends. When in use, the dimensions of the rigid nesting frame are configured to receive at least a part of carrier 100. Such a rigid nesting frame may be configured such that it may be converted into a stand and, in some embodiments, may comprise telescoping legs configured to be disposed substantially in between or below first and second side panels 110, 120 and to be opened to a width sufficient to rest carrier 100 containing the balls therein when in use. In some embodiments, spacers of the rigid nesting frame will be similar to, but longer than spacers 130*a*-130*d* as previously described for fixing first and second side panels 110, 120 of carrier 100. Accordingly, the longest width and/or depth of such a rigid nesting frame may be at least slightly longer than the longest corresponding width and/or depth of carrier 100, and the shortest width and/or depth of such a rigid nesting frame may be at least slightly longer than the corresponding shortest width and/or depth of carrier 100 so that carrier 100 can nest inside the rigid nesting frame. In some such embodiments, entire carrier 100, including such a rigid nesting frame, may still fit within a racket shaped bag. Such a rigid nesting frame may have roughly the same range of dimensions as carrier 100 outlined above (lengths, slopes, angles, etc.), although when used together the dimensions of the rigid nesting frame will be slightly larger to accommodate at least a portion of carrier 100 therein. In some embodiments, the rigid nesting frame converts to a stand wherein the legs stand at a substantially 90-degree angle with respect to the ground. In such embodiments, the legs of the rigid nesting frame will, advantageously, be less likely to slip out from under carrier 100 as is common with conventional carriers having angled legs.

A bumper material (not shown) such as rubber or plastic may be attached to a portion such as the edges or all of carrier 100 (e.g., on one or more of first and second side panels 110, 120) to act as a spacer, to soften any contact with a ball court, and to minimize any potential damage to the court, carrier, or any other gear simultaneously disposed in a racket shaped bag when carrier 100 is stored.

Figure 8:
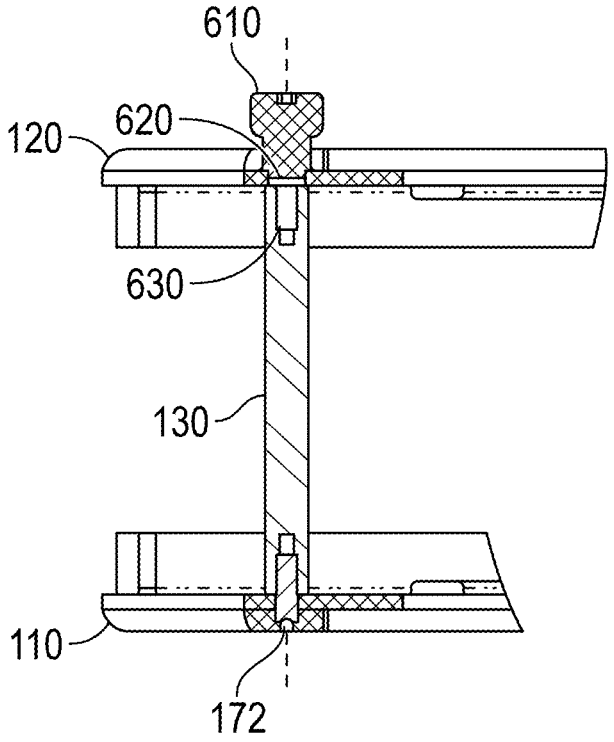
FIG. 8 shows a cutaway view of the carrier frame as viewed in the direction of the cutline C-C' of FIG. 7, in accordance with some embodiments.
Figure 9:
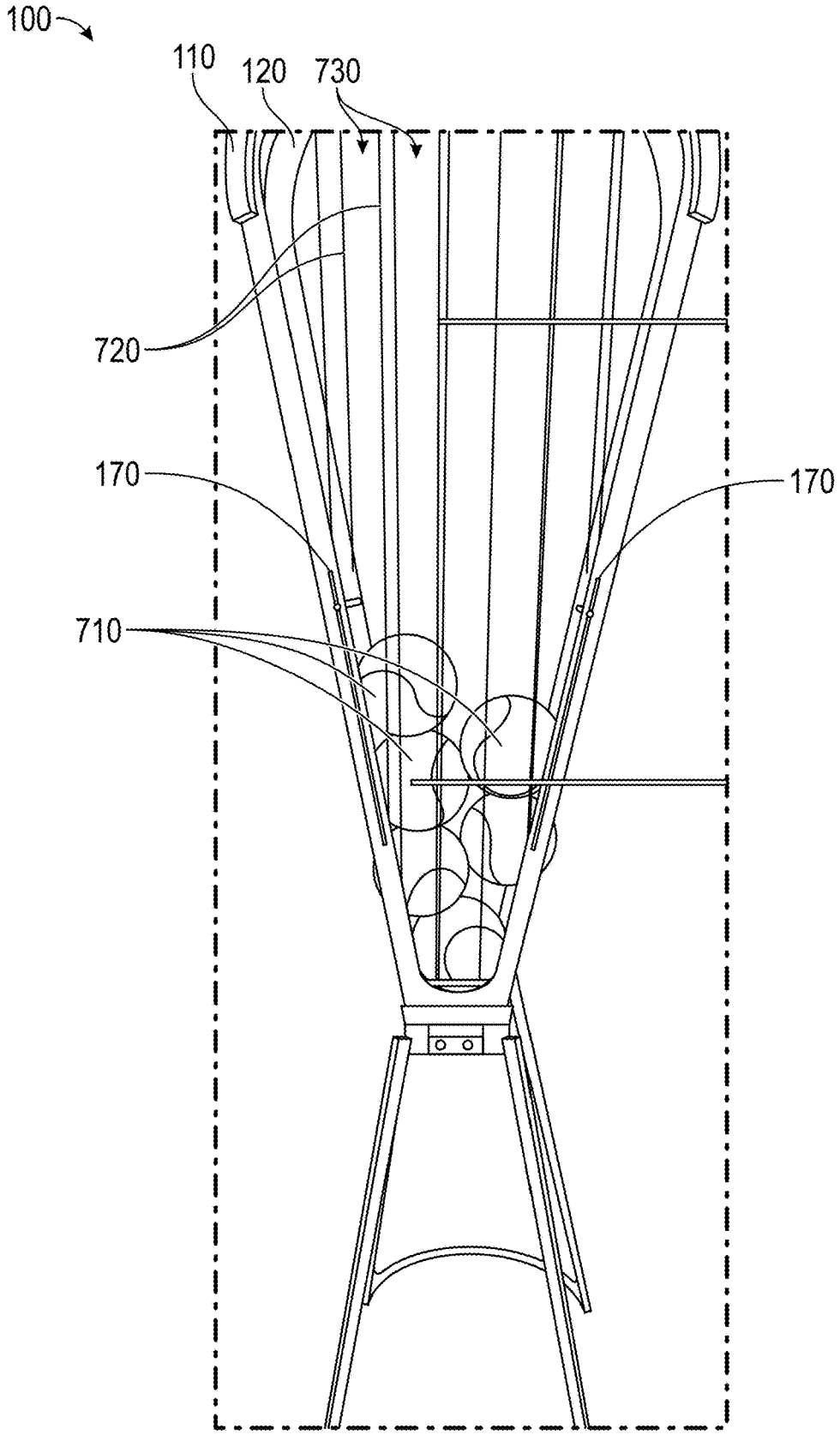
FIG. 9 shows a carrier according to embodiment(s) herein having a plurality of strings extending across side openings, a plurality of balls disposed within the carrier cavity and optional collapsible legs in the extended position and used as a stand, in accordance with some embodiments.
Figure 10:
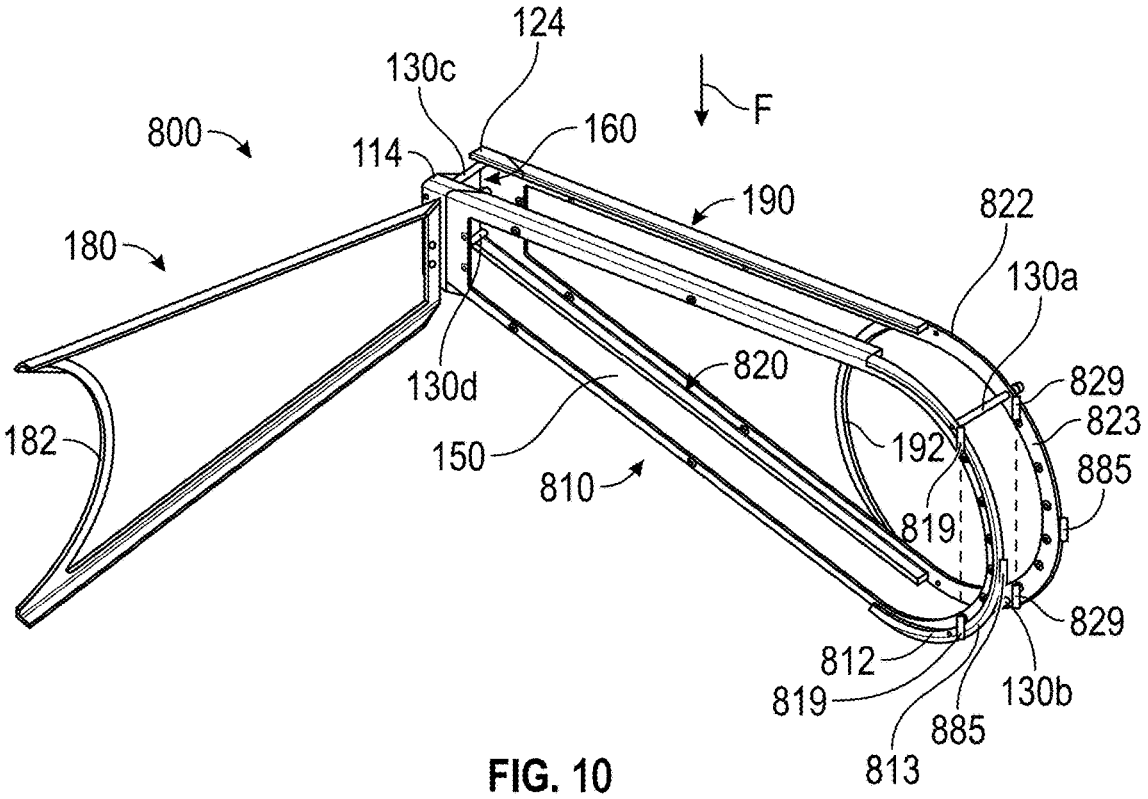
FIG. 10 shows a perspective view of another carrier frame with an optional collapsible leg in an extended position, in accordance with some embodiments.
Figure 11:
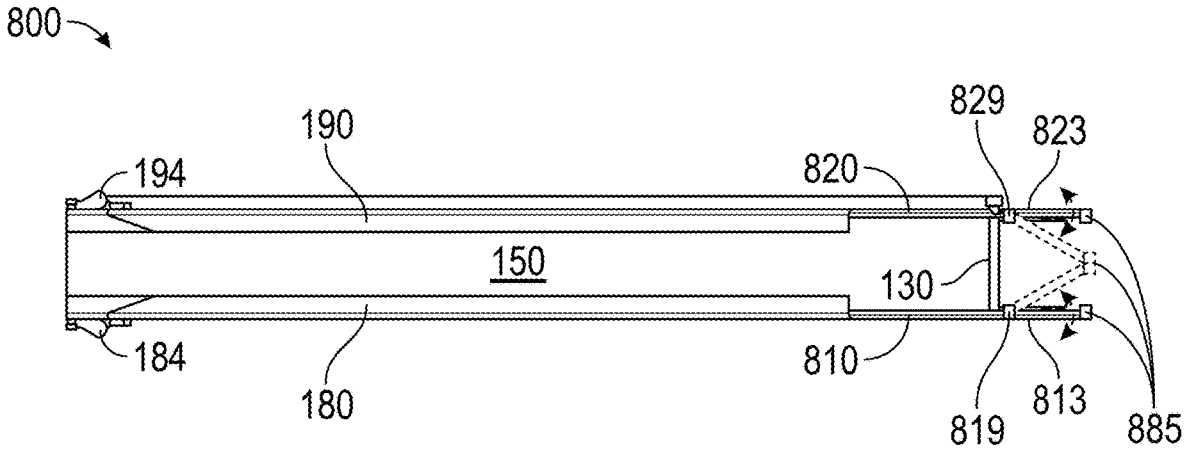
FIG. 11 shows a side view of the carrier frame of FIG. 10 as viewed in the direction of the arrow F in FIG. 10 but with the collapsible leg that was extended in FIG. 10 now in a collapsed state, in accordance with some embodiments.

In some other embodiments, a carrier, for example carrier 800 as illustrated in at least FIGS. 10 and 11, may have respective hinges 819, 820 coupled to respective portions of its first and second side panels 810, 820, such that respective hinged proximal portions 813, 823 of first and second side panels 810, 820 are configured to pivot with respect to the rest of first and second side panels 810, 820 about respective hinge axes, as denoted by the dotted lines extending between hinges 819, 820 in FIG. 8, and thereby close cavity 150 when hinged proximal portions 813, 823 are pivoted anywhere from inline with the direction of extent of carrier 800 and its first and second side panels 810, 820 inward, and open cavity 150 sufficiently to release balls therefrom when hinged proximal portions 813, 823 are pivoted anywhere outward from inline with the direction of extent of carrier 800 and its first and second side panels 810, 820. Such embodiments of carrier 800 may additionally have some or all of the components previously described in connection with carrier 100 and those components are contemplated to have substantially the same structure and operation as previously described anywhere in this disclosure unless specifically disclosed otherwise.

In some embodiments, carrier 800 may further comprise locking mechanism 885 disposed on one or both of hinged proximal portions 813, 823 and configured to lock hinged proximal portions 813, 823 in a position that maintains the balls in cavity 150, for example, an orientation as illustrated by the dotted lines in FIG. 11. In this way, hinged proximal portions 813, 823 may be configured to pivot, swing or swivel inward about their respective axes until their proximal edges touch one another or until a locking mechanism 885 disposed thereon is in the locked position and, in some cases, also configured to pivot, swing or swivel outward about their respective axes, in some cases by nearly 180 degrees, until they are disposed against respective adjacent outer portions of first and second side panels 810, 820 in a fully opened position.

In some embodiments, any carrier described herein may further comprise a handle or strap (not shown) to facilitate carrying the carrier when in use.

In some embodiments, any carrier described herein may be collapsible and/or shipped in parts that may be assembled by a user. For example, a carrier assembly package may contain the individual components of any carrier detailed herein. Any rigid nesting frame as described anywhere herein may similarly be collapsible and/or shipped in parts for assembly by a user.

FURTHER EXAMPLE EMBODIMENTS

Example 1

Various sized standoff posts were tested to determine whether tennis balls would push out the perimeter of the carrier while being collected. Using a Penn and Wilson regulation tennis ball for the testing, a 2.5" standoff post works well for pressing down on the balls, but balls tended to push out the sides. In some embodiments, if this length standoff is used, an L-shape ledge may be included on at least one of first and second side panels 110, 120 to decrease the predetermined spacing D therebetween. Using the same tennis ball, 2" standoff posts were too tight and did not allow the balls to move freely within the cavity when respective openings 116, 126 of first and second side panels 110, 120 were strung with string 720.

Example 2

Six side panels (2 each for 3 slightly different sizes) were cut from a 4'×1' sheet of ¼" thick 5052 aluminum. Each of the side panels were made with seven holes where the standoffs connect to the side panels. The holes are countersunk so a screw/bolt is used that will be flush with the outside edge of the side panels when installed. These holes are drilled for a #6 screw (6/32), which is the smallest screw that can be used with a Philips #2 screwdriver. Depending on the final width and thickness of the frame, either a #6 screw or a 4/40 screw (uses smaller Philips #1 screwdriver) will be used. Although a #2 Phillips screwdriver is more common than a #1, a smaller hole size (4/40) may be required if the frame is very narrow.

Example 3

Another carrier was made using a high precision cutter to cut sheet metal for the side panels and the collapsible legs. The holes on the side panels for the strings/screws were also cut with the high precision cutter. Some forming/bending equipment can be used to strengthen the stiffness of the sheet metal for both the side panels and the legs (this particular version only has bends in the legs, but a bend could also be used along the edges or perimeter of the side panels of the frame as described herein). The collapsible legs in closed position may sit on top of the frame comprising the side panels. Additional pieces of sheet metal were added at the proximal as well as tapered distal ends to both add structural integrity for when the carrier is collecting balls (e.g., by pressing into the ground), but also to facilitate a flush surface for the leg hinge(s) at the bottom and to provide a curved, e.g., circular, semicircular or elliptical shape at the top. These two pieces of additional sheet metal were pressed into the frame with press inserts/fasteners from Penn Engineering (but they could also or alternatively be welded). The side panels were powder coated prior to hinge assembly. The hinges attached to the legs and frame comprising the first and second side panels via threaded press inserts (e.g., nuts) and 8/32 machine screws. The two side panels are attached together with 4/40 screws and 2¼" length×¼" diameter standoffs. Plastic grommet string protectors (rubber grommets are also suitable) were inserted into the string holes to protect the string from breaking during the stringing process. String was pulled tight under hand tension but a machine tensioner, similar to those for rackets, may also or alternatively be used.

Various aspects of the novel systems, apparatuses, and methods are described more fully hereinafter with reference to the accompanying drawings. The teachings disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of or combined with any other aspect of the disclosure. For example, a system or an apparatus may be implemented, or a method may be practiced using any one or more of the aspects set forth herein. In addition, the scope of the disclosure is intended to cover such a system, apparatus or method which is practiced using other structure, functionality, or structure and functionality in addition to or other than the various aspects of the disclosure set forth herein. It should be understood that any aspect disclosed herein may be set forth in one or more elements of a claim. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof.

General Interpretive Principles for the Present Disclosure

Various aspects of the novel systems, apparatuses, and methods are described more fully hereinafter with reference to the accompanying drawings. The teachings disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of or combined with any other aspect of the disclosure. For example, a system or an apparatus may be implemented, or a method may be practiced using any one or more of the aspects set forth herein. In addition, the scope of the disclosure is intended to cover such a system, apparatus or method which is practiced using other structure, functionality, or structure and functionality in addition to or other than the various aspects of the disclosure set forth herein. It should be understood that any aspect disclosed herein may be set forth in one or more elements of a claim. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof.

With respect to the use of plural vs. singular terms herein, those having skill in the art can translate from the plural to the singular and/or from the singular to the plural as is appropriate to the context and/or application. The various singular/plural permutations may be expressly set forth herein for sake of clarity.

When describing an absolute value of a characteristic or property of a thing or act described herein, the terms "substantial," "substantially," "essentially," "approximately," and/or other terms or phrases of degree may be used without the specific recitation of a numerical range. When applied to a characteristic or property of a thing or act described herein, these terms refer to a range of the characteristic or property that is consistent with providing a desired function associated with that characteristic or property. For example, the terms "approximately," "about" and "substantially" may refer to an amount that is within less than 10% of, within less than 5% of, within less than 1% of, within less than 0.1% of, and within less than 0.01% of the stated amount.

In those cases where a single numerical value is given for a characteristic or property, it is intended to be interpreted as at least covering deviations of that value within one significant digit of the numerical value given.

If a numerical value or range of numerical values is provided to define a characteristic or property of a thing or act described herein, whether or not the value or range is qualified with a term of degree, a specific method of measuring the characteristic or property may be defined herein as well. In the event no specific method of measuring the characteristic or property is defined herein, and there are different generally accepted methods of measurement for the characteristic or property, then the measurement method should be interpreted as the method of measurement that would most likely be adopted by one of ordinary skill in the art given the description and context of the characteristic or property. In the further event there is more than one method of measurement that is equally likely to be adopted by one of ordinary skill in the art to measure the characteristic or property, the value or range of values should be interpreted as being met regardless of which method of measurement is chosen.

It will be understood by those within the art that terms used herein, and especially in the appended claims (e.g., bodies of the appended claims) are intended as "open" terms unless specifically indicated otherwise (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

In those instances where a convention analogous to "at least one of A, B, and C" is used, such a construction would include systems that have A alone, B alone, C alone, A and B together without C, A and C together without B, B and C together without A, as well as A, B, and C together. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include A without B, B without A, as well as A and B together."

Various modifications to the implementations described in this disclosure can be readily apparent to those skilled in the art, and generic principles defined herein can be applied to other implementations without departing from the spirit or scope of this disclosure. Thus, the disclosure is not intended to be limited to the implementations shown herein but is to be accorded the widest scope consistent with the claims, the principles and the novel features disclosed herein. The word "exemplary" is used exclusively herein to mean "serving as an example, instance, or illustration." Any implementation described herein as "exemplary" is not necessarily to be construed as preferred or advantageous over other implementations.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

What is claimed is:

1. A ball carrier configured to hold a plurality of sports balls, the carrier comprising:

a first frame portion defining a first substantially planar geometric shape;

a second frame portion defining a second substantially planar geometric shape;

wherein the first frame portion and the second frame portion are positioned substantially parallel to each other to form a sports ball carrier having an internal volume defined by the first frame portion and the second frame portion for holding a plurality of sports balls;

wherein the internal volume has a thickness between the substantially parallel planes of the first frame portion and the second frame portion such that the first frame portion and the second frame portion capture the sports balls in the internal volume of the carrier as a substantially planar, one sports ball thick array;

at least one spacer coupling the first frame portion to the second frame portion such that respective adjacent edges of the first and second frame portions are laterally spaced from one another by less than a diameter of the sports balls.

2. The ball carrier of claim 1, comprising a sports ball entry port.

3. The ball carrier of claim 1, wherein the sports balls comprise tennis balls.

4. The ball carrier of claim 2, wherein the sports ball entry port is configured to deform a sports ball as the sports ball passes through the sports ball entry port.

5. The ball carrier of claim 1, wherein the internal volume has a length and a width, and wherein the width changes along the length.

6. The ball carrier of claim 5, wherein the width increases in size from a first end of the ball carrier to a second end of the ball carrier.

7. The ball carrier of claim 5, wherein a maximum width of the ball carrier internal volume is more than three times the diameter of a regulation sports ball and less than six times the diameter of a regulation sports ball.

8. The ball carrier of claim 1, wherein at least one of the first frame portion and the second frame portion comprises an opening, wherein the opening has is spanned by at least one string.

9. The ball carrier of claim 8, wherein the at least one string is strung across the opening multiple times such that it extends in one or both of a substantially horizontal direction and a substantially vertical direction.

10. The ball carrier of claim 8, wherein the at least one string comprises at least one of a fabric, an elastic band, a mesh, a netting and a racket string.

11. The ball carrier of claim 1, wherein the first substantially planar geometric shape is substantially congruent with the second substantially planar geometric shape.

12. The ball carrier of claim 1, wherein the first and second geometric shapes are polygons.

13. The ball carrier of claim 1, wherein the first and second geometric shapes comprise a curved portion.

14. The ball carrier of claim 1, wherein the at least one spacer comprises a telescoping post configured to maintain a lateral spacing between the first and second side panels at a predetermined distance during ball collection and configured to allow an increase of the lateral spacing to a distance greater than a diameter of the sports balls to thereby release the balls from the ball carrier.

15. The ball carrier of claim 1, wherein the internal volume defined by the frame comprises a length, a maximum width, a minimum width, and a thickness, wherein the length is at least 1.5 times the maximum width, and wherein the maximum width is at least 3 times the thickness.

16. The ball carrier of claim 15, wherein the frame tapers from the maximum width to the minimum width along the length.

17. A ball carrier configured to hold a plurality of sports balls, the carrier comprising:

a first frame portion defining a first substantially planar geometric shape;

a second frame portion defining a second substantially planar geometric shape;

wherein the first frame portion and the second frame portion are positioned substantially parallel to each other to form a sports ball carrier having an internal volume defined by the first frame portion and the second frame portion for holding a plurality of sports balls;

wherein the internal volume has a thickness between the substantially parallel planes of the first frame portion and the second frame portion such that the first frame portion and the second frame portion capture the sports balls in the internal volume of the carrier as a substantially planar, one sports ball thick array;

a first collapsible leg coupled to the first frame portion utilizing a first hinge; and a second collapsible leg coupled to the second frame portion utilizing a second hinge, the first and second collapsible legs configured to fold against the first and second frame portions, respectively, when collapsed.

* * * * *